US010465992B2

(12) United States Patent
DeLugan et al.

(10) Patent No.: US 10,465,992 B2
(45) Date of Patent: Nov. 5, 2019

(54) PARTING SHEET IN HEAT EXCHANGER CORE

(71) Applicant: Hamilton Sundstrand Corporation, Charlotte, NC (US)

(72) Inventors: Anthony DeLugan, Agawam, MA (US); Matthew William Miller, Enfield, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 15/923,189

(22) Filed: Mar. 16, 2018

(65) Prior Publication Data

US 2019/0285351 A1 Sep. 19, 2019

(51) Int. Cl.
*F28D 9/00* (2006.01)
*F28F 3/02* (2006.01)

(52) U.S. Cl.
CPC ..... *F28D 9/0062* (2013.01); *F28F 3/025* (2013.01); *F28F 2250/106* (2013.01)

(58) Field of Classification Search
CPC .... F28D 9/0062; F28D 9/0037; F28D 9/0025; F28F 2225/00
USPC ..... 165/134.1, 166, 167, 906
See application file for complete search history.

(56) References Cited

U.S. PATENT DOCUMENTS

| | | | | | |
|---|---|---|---|---|---|
| 3,601,185 | A * | 8/1971 | Rothman | F28D 9/0062 | 165/166 |
| 4,049,051 | A * | 9/1977 | Parker | F28F 3/027 | 165/146 |
| 4,229,868 | A | 10/1980 | Kretzinger | | |
| 4,254,827 | A * | 3/1981 | Forster | F28D 9/0025 | 165/165 |
| 8,028,410 | B2 * | 10/2011 | Thompson | F28D 9/0043 | 165/167 |
| 8,646,516 | B2 * | 2/2014 | Abels | F28D 1/0316 | 165/166 |
| 2003/0000687 | A1 * | 1/2003 | Mathur | F28D 9/0037 | 165/166 |
| 2014/0065505 | A1 * | 3/2014 | Saito | H01M 8/04164 | 429/436 |
| 2015/0361922 | A1 * | 12/2015 | Alvarez | F28F 9/0268 | 165/185 |
| 2018/0058765 | A1 * | 3/2018 | Parfenov | F28D 9/0062 | |

FOREIGN PATENT DOCUMENTS

| | | | |
|---|---|---|---|
| CN | 103471434 | B | 12/2017 |
| EP | 3034978 | B1 * | 6/2016 |
| JP | 03271697 | A * | 12/1991 |
| WO | 2017073779 | A1 | 5/2017 |

* cited by examiner

*Primary Examiner* — Allen J Flanigan
(74) *Attorney, Agent, or Firm* — Kinney & Lange, P.A.

(57) ABSTRACT

A heat exchanger core includes a first standard sheet having a first face and a second face opposite of the first face, a second standard sheet opposing the first face of the first standard sheet, a first fin extending between the first standard sheet and the second standard sheet, the first fin defining multiple channels, and a first partial sheet connected to the first face. The first partial sheet is smaller in width and/or height than the first face of the first standard sheet.

18 Claims, 3 Drawing Sheets

PARTING SHEET IN HEAT EXCHANGER CORE

BACKGROUND

Cross-flow heat exchangers are comprised of a series of layers that alternate between cold and hot, with the cold fluid flowing one direction and the hot fluid flowing another direction. The cold and hot fluids are kept separate but are in close proximity to one another in order to facilitate heat transfer. Therefore, some of the structures in cross-flow heat exchangers are constructed without excess bulk so they have relatively low strength. In order to handle the stresses due to thermal gradients that are present during operation of a cross-flow heat exchanger, reinforcement components can be added, although these oftentimes add unnecessary material and/or disrupt the flow of the cold and/or hot fluid.

SUMMARY

According to one embodiment, a heat exchanger core includes a first standard sheet having a first face and a second face opposite of the first face, a second standard sheet opposing the first face of the first standard sheet, a first fin extending between the first standard sheet and the second standard sheet, the first fin defining multiple channels, and a first partial sheet connected to the first face. The first partial sheet is smaller in width and/or height than the first face of the first standard sheet.

According to another embodiment, a heat exchanger core includes a first layer including first channels extending in a first direction and a first partial sheet that is shorter than the first channels along the first direction. A second layer is adjacent to the first layer, and the second layer includes second channels extending in a second direction that is different from the first direction.

DETAILED DESCRIPTION

Figure 1:
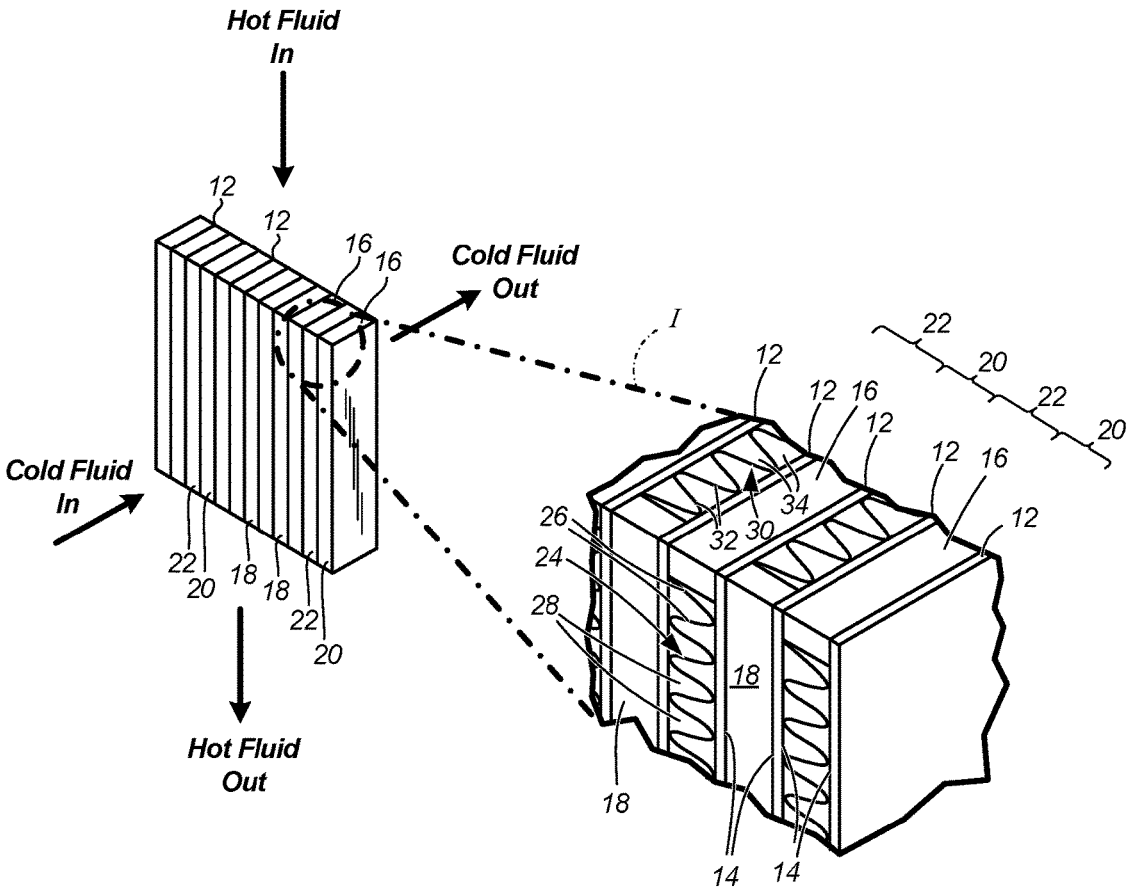
FIG. 1 is a perspective view of a cross-flow heat exchanger core including close-up inset I.

FIG. 1 is a perspective view of cross-flow heat exchanger core 10 including close-up inset I. In the illustrated embodiment, core 10 is comprised of a plurality of parallel parting sheets 12 each with two faces 14 that oppose faces 14 of the adjacent parting sheets 12. Positioned between alternating pairs of parting sheets 12 are cold closure bars 16, and positioned between the remaining pairs of parting sheets 12 are hot closure bars 18. Cold closure bars 16 are positioned along two opposing edges of core 10, and hot closure bars 18 are positioned along the other two opposing edges of core 10. Thereby, core 10 has a layered architecture that is comprised of a cold layers 20 alternating with hot layers 22. Each cold layer 20 includes two adjacent parting sheets 12 and a pair of cold closure bars 16, and each hot layer 22 includes two adjacent parting sheets 12 and a pair of hot closure bars 18, wherein each cold layer 20 shares parting sheets 12 with hot layers 22.

Within each cold layer 20 is a ruffled cold fin 24. Cold fin 24 is a corrugated sheet with a plurality of cold segments 26 that sized and configured to extend between and be brazed to the corresponding parting sheets 12. Thereby, each cold layer 20 is divided into a plurality of cold channels 28 by the plurality of cold segments 26. The plurality of cold channels 28 extend parallel to cold closure bars 16.

Within each hot layer 22 is a ruffled hot fin 30. Hot fin 30 is a corrugated sheet with a plurality of hot segments 32 that sized and configured to extend between and be brazed to the corresponding parting sheets 12. Thereby, each hot layer 22 is divided into a plurality of hot channels 34 by the plurality of hot segments 32. The plurality of hot channels 34 extend parallel to hot closure bars 18. In the illustrated embodiment, core 10 the shape of a rectangular prism, so hot channels 34 extend perpendicularly to cold channels 28.

During operation of cross-flow heat exchanger core 10, a cold fluid (not shown) is flowed through cold channels 28 while a hot fluid (not shown) is flowed through hot channels 34. Fins 24 and 30 and parting sheets 12 allow heat to be transferred from the hot fluid to the cold fluid, cooling the hot fluid and warming the cold fluid.

Figure 2:
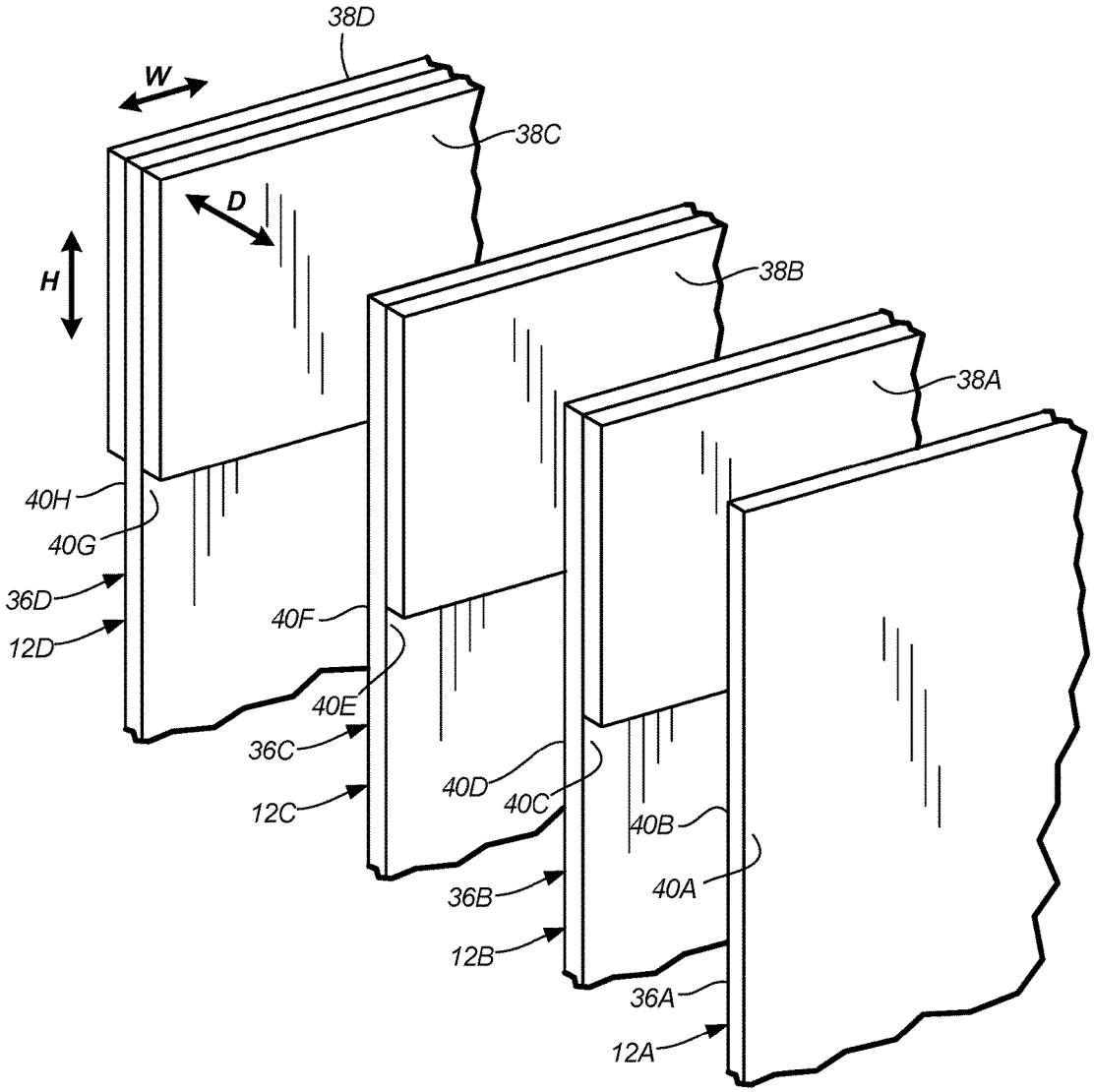
FIG. 2 is an exploded perspective view of a plurality of parting sheets of the heat exchanger core.

FIG. 2 is an exploded perspective view of a plurality of parting sheets 12 of cross-flow heat exchanger core 10 (shown in FIG. 1). More specifically, FIG. 2 shows parting sheets 12A-12D, at least some of which are comprised of a standard sheet 36 and a partial sheet 38. Standard sheets 36 are the full size of core 10, but partial sheets 38 are smaller in one dimension than standard sheets 36, for example, height in axis H, and full-sized in the other dimension, such as width along axis W. In the illustrated embodiment, partial sheets 38 begin even with standard sheets 36 where the hot fluid enters core 10, but only extend 5% to 25% as far as standard sheets 36 towards where the hot fluid exits core 10 (as depicted in FIG. 2, this value is 20%). In addition, each partial sheet 38 is positioned between a standard sheet and a cold closure bar 16 or a hot closure bar 18. Therefore, modifications (not shown) may be needed to the edge of the corresponding bar 16 or 18 in order to accommodate a partial sheet 38. Alternatively, cold closure bars 16 and hot closure bars 18 can be rectangular along their entire lengths, and partial sheets 38 can be smaller in both height and width than standard sheets 36. In such an embodiment, the reduction in size of a partial sheet 38 is minor (i.e., just enough to accommodate one of bars 16 and 18) along one of axes H and W and major (i.e., 5%-25%) along the other of axes H and W.

In the illustrated embodiment, standard sheets 36 and partial sheets 38 are the same thickness, and one of partial sheets 38A-38D is brazed to one of sides 40A-40H of standard sheets 36A-36D, respectively. Thereby, partial sheets 38 structurally reinforce standard sheets 36 where the hot fluid enters core 10. There is an opportunity to vary which sides 40A-40H are connected to a partial sheet 38. For example, standard sheet 36B includes partial sheet 38A on side 40C, which is in a cold layer 20 (shown in FIG. 1). For another example, standard sheet 36C includes partial sheet 38B on face 40E, which is in a hot layer 22 (shown in FIG. 1). For yet another example, standard sheet 36D includes partial sheets 38C on side 40G (in a cold layer 20) and partial sheet 38D on side 40H (in a hot layer 22). While FIG. 2 shows several different configurations of parting sheets 12, core 10 (shown in FIG. 1) may have different configurations of parting sheets 12 with partial sheets 38 or a repeating pattern of parting sheets 12 with partial sheets 38.

The components and configuration of parting sheets 12 allow for reinforcement of core 10 (shown in FIG. 1) in the areas where it may most be beneficial to prevent negative effects from thermal stresses (e.g., uneven thermal growth gradients). Using partial sheets 38 that are smaller than standard sheets 36 to do the reinforcing saves weight.

Shown in FIG. 2 is one embodiment of the plurality of parting sheets 12, to which there are alternative embodiments. For example, partial sheets 38 can have different thicknesses from standard sheets 36 and/or from themselves. For another example, partial sheets 38 can begin even with standard sheets 36 where the cold fluid enters core 10, but only extend 5% to 25% as far as standard sheets 36 towards where the cold fluid exits core 10. For another example, partial sheets 38 can be placed even with standard sheets wherever the fluid enters core 10, such that the partial sheets 38 in hot layers 22 would be even with one side of core 10, and the partial sheets 38 in cold layers 20 would be even with an adjacent side of core 10. For another example, a parting sheet 12 can include a plurality of spaced-apart partial sheets 38.

Figure 3A:
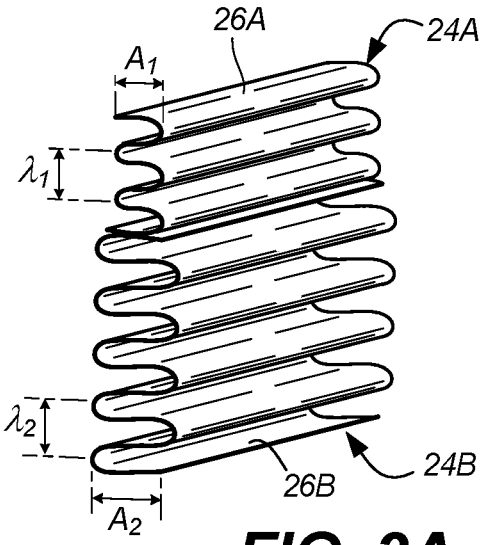
FIG. 3A is a perspective view of a plurality of fins of the heat exchanger core.

FIG. 3A is a perspective view of cold fins 24A and 24B of the cross-flow heat exchanger core 10 (shown in FIG. 1). In the illustrated embodiment, cold fins 24A and 24B are connected to parting sheets 12A and 12B (shown in FIG. 2). Cold fin 24A starts at the end of core 10 where the hot fluid enters and extends to the edge of partial sheet 38A (shown in FIG. 2). Cold fin 24B starts at the end of core 10 where the hot fluid exits and extends to the edge of partial sheet 38A, adjacent to and abutting cold fin 24A. Thereby, cold fin 24A has a smaller amplitude $A_1$ than cold fin 24B amplitude $A_2$. This is because amplitude $A_1$ is sized to fit the distance between parting sheets 12A and 12B, which are closer together along axis D (shown in FIG. 2) due to partial sheet 38A being present and occupying space along axis D, whereas amplitude $A_2$ is sized to fit the distance between parting sheets 12A and 12B without partial sheet 38A being present and occupying space along axis D. But the sheet thickness and wavelength $\lambda_1$ of cold segments 26A in cold fin 24A are the same as the sheet thickness and wavelength $\lambda_2$ of cold segments 26B in cold fin 24B.

Figure 3B:
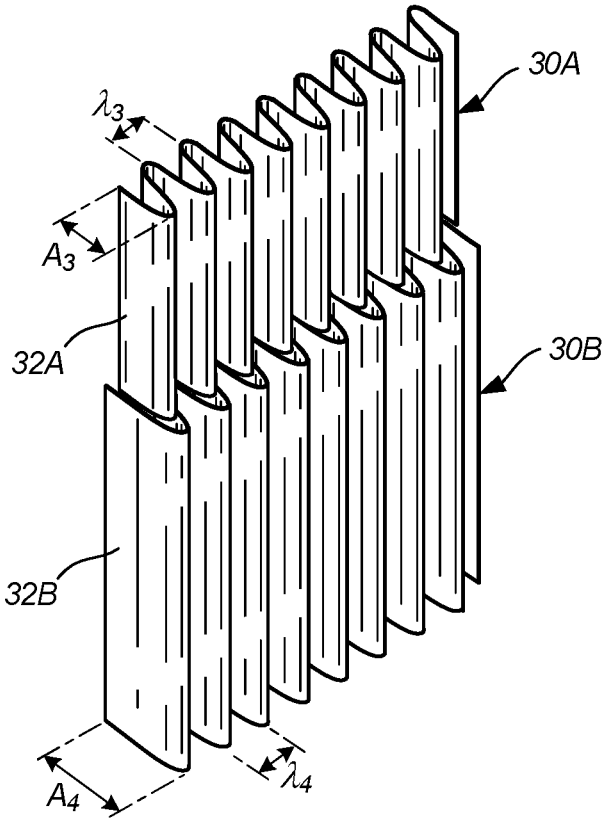
FIG. 3B is a perspective view of another plurality of fins of the heat exchanger core.

FIG. 3B is a perspective view of hot fins 30A and 30B of the cross-flow heat exchanger core 10 (shown in FIG. 1). In the illustrated embodiment, hot fins 30A and 30B are connected to parting sheets 12B and 12C (shown in FIG. 2). Hot fin 30A starts at the end of core 10 where the hot fluid enters and extends to the edge of partial sheet 38B (shown in FIG. 2). Hot fin 30B starts at the end of core 10 where the hot fluid exits and extends to the edge of partial sheet 38B, adjacent to and abutting hot fin 30A. Thereby, hot fin 30A has a smaller amplitude $A_3$ than hot fin 30B amplitude $A_4$. This is because amplitude $A_3$ is sized to fit the distance between parting sheets 12B and 12C, which are closer together along axis D (shown in FIG. 2) due to partial sheet 38B being present and occupying space along axis D, whereas amplitude $A_4$ is sized to fit the distance between parting sheets 12B and 12C without partial sheet 38B being present and occupying space along axis D. But the sheet thickness and wavelength $\lambda_3$ of hot segments 32A in hot fin 30A are the same as the sheet thickness and wavelength $\lambda_4$ of hot segments 32B in hot fin 30B.

Discussion of Possible Embodiments

The following are non-exclusive descriptions of possible embodiments of the present invention.

A heat exchanger core according to an exemplary embodiment of this disclosure, among other possible things includes: a first standard sheet having a first face and a second face opposite of the first face; a second standard sheet opposing the first face of the first standard sheet; a first fin extending between the first standard sheet and the second standard sheet; and a first partial sheet connected to the first face, the first partial sheet being smaller in at least one of width and height than the first face of the first standard sheet.

The heat exchanger core of the preceding paragraph can optionally include, additionally and/or alternatively, any one or more of the following features, configurations and/or additional components:

A further embodiment of the foregoing heat exchanger core, wherein the first fin can be connected to the first face of the first standard sheet and to the second standard sheet.

A further embodiment of any of the foregoing heat exchanger cores, wherein the heat exchanger core can further comprise: a second fin connected to the first partial sheet and to the second standard sheet, the second fin being adjacent to the first fin.

A further embodiment of any of the foregoing heat exchanger cores, wherein the heat exchanger core can further comprise: a third standard sheet; a third fin extending between the second side of the first standard sheet and the third standard sheet; and a second partial sheet connected to one of the first face and the third standard sheet.

A further embodiment of any of the foregoing heat exchanger cores, wherein the heat exchanger core can further comprise: a fourth fin connected to the second partial sheet and to the other of the first face and the third standard sheet, the fourth fin being adjacent to the third fin.

A further embodiment of any of the foregoing heat exchanger cores, wherein the first plurality of channels extend perpendicularly with respect to the third plurality of channels.

A further embodiment of any of the foregoing heat exchanger cores, wherein a width of the first partial sheet can be the same as a width of the first standard sheet.

A further embodiment of any of the foregoing heat exchanger cores, wherein a height of the first partial sheet can be from 5% to 25% of a height of the first standard sheet.

A further embodiment of any of the foregoing heat exchanger cores, wherein a height of the first partial sheet can be the same as a height of the first standard sheet.

A further embodiment of any of the foregoing heat exchanger cores, wherein a width of the first partial sheet can be from 5% to 25% of a width of the first standard sheet.

A heat exchanger core according to an exemplary embodiment of this disclosure, among other possible things includes: a first layer including a first plurality of channels extending in a first direction and a first partial sheet that is shorter than the first plurality of channels along the first direction; and a second layer adjacent to the first layer, the second layer including a second plurality of channels extending in a second direction that is different from the first direction.

The heat exchanger core of the preceding paragraph can optionally include, additionally and/or alternatively, any one or more of the following features, configurations and/or additional components:

A further embodiment of the foregoing heat exchanger core, wherein the first plurality of channels can be defined by a first fin.

A further embodiment of any of the foregoing heat exchanger cores, wherein the first plurality of channels can be defined by an upstream fin and an adjacent downstream fin.

A further embodiment of any of the foregoing heat exchanger cores, wherein the second plurality of channels can be defined by a second fin.

A further embodiment of any of the foregoing heat exchanger cores, wherein the second plurality of channels can be defined by a third fin and a fourth fin adjacent to and alongside of the third fin.

A further embodiment of any of the foregoing heat exchanger cores, wherein the second layer can further comprise: a second partial sheet that is shorter than the first plurality of channels along the first direction.

A further embodiment of any of the foregoing heat exchanger cores, wherein a width of the second partial sheet can be the same as a width of the second layer, and a height of the second partial sheet can be from 5% to 25% of a length of the second layer.

A further embodiment of any of the foregoing heat exchanger cores, wherein the first direction can be perpendicular to the second direction.

A further embodiment of any of the foregoing heat exchanger cores, wherein a width of the first partial sheet can be the same as a width of the first layer.

A further embodiment of any of the foregoing heat exchanger cores, wherein a length of the first partial sheet can be from 5% to 25% of a length of the first layer.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A heat exchanger core comprising:

a first standard sheet having a first face and a second face opposite of the first face;

a second standard sheet opposing the first face of the first standard sheet;

a first fin extending between the first standard sheet and the second standard sheet, the first fin defining a first plurality of channels;

a first partial sheet connected to the first face, the first partial sheet being smaller in at least one of width and height than the first face of the first standard sheet; and a second fin between the first partial sheet and the second standard sheet, wherein the second fin is connected to the first partial sheet and abuts and is attached to a section of the second standard sheet, the second fin defining a second plurality of channels and the second fin being adjacent to the first fin;

wherein the first fin is connected to the first face of the first standard sheet and to the second standard sheet.

2. The heat exchanger core of claim 1, further comprising:

a third standard sheet;

a third fin extending between the second face of the first standard sheet and the third standard sheet, the third fin defining a third plurality of channels; and a second partial sheet connected to one of the second face and the third standard sheet.

3. The heat exchanger core of claim 2, further comprising:

a fourth fin connected to the second partial sheet and to the other of the second face and the third standard sheet, the fourth fin defining a fourth plurality of channels, the fourth fin being adjacent to the third fin.

4. The heat exchanger core of claim 2, wherein the first plurality of channels extend perpendicularly with respect to the third plurality of channels.

5. The heat exchanger core of claim 1, wherein a width of the first partial sheet is the same as a width of the first standard sheet.

6. The heat exchanger core of claim 5, wherein a height of the first partial sheet is from 5% to 25% of a height of the first standard sheet.

7. The heat exchanger core of claim 1, wherein a height of the first partial sheet is the same as a height of the first standard sheet.

8. The heat exchanger core of claim 6, wherein a width of the first partial sheet is from 5% to 25% of a width of the first standard sheet.

9. A heat exchanger core comprising:

a first standard sheet having a first face and a second face opposite the first face;

a second standard sheet opposing the first face of the first standard sheet;

a first layer including:

a first fin and a second fin, adjacent to one another, together defining a first plurality of channels extending in a first direction, wherein the second fin abuts to and is attached to a portion of a surface of the second standard sheet; and a first partial sheet between the first face of the first standard sheet and the face of the second standard sheet that is shorter than the first plurality of channels along the first direction;

wherein the first partial sheet is connected to the second fin; and a second layer adjacent to the first layer, the second layer including a third fin at least partially defining a second plurality of channels extending in a second direction that is different from the first direction.

10. The heat exchanger core of claim 9, wherein the first of the second fin.

11. The heat exchanger core of claim 9, wherein the second plurality of channels is defined by the third fin and a fourth fin adjacent to and alongside of the third fin.

12. The heat exchanger core of claim 9, wherein the second layer further comprises:

a second partial sheet that is shorter than the first plurality of channels along the first direction.

13. The heat exchanger core of claim 12, wherein a width of the second partial sheet is the same as a width of the second layer, and a height of the second partial sheet is from 5% to 25% of a length of the second layer.

14. The heat exchanger core of claim 9, wherein the first direction is perpendicular to the second direction.

15. The heat exchanger core of claim 9, wherein a width of the first partial sheet is the same as a width of the first layer.

16. The heat exchanger core of claim 15, wherein a length of the first partial sheet is from 5% to 25% of a length of the first layer.

17. The heat exchanger core of claim 1, wherein:

the first fin defines a first fin amplitude;

the second fin defines a second fin amplitude; and the first fin amplitude is greater than the second fin amplitude.

18. The heat exchanger core of claim 12, wherein:

the second partial sheet is connected to the third fin;

the third fin defines a third fin amplitude;

the fourth fin defines a fourth fin amplitude; and the third fin amplitude is greater than the fourth fin amplitude.

* * * * *